US008430212B2

(12) United States Patent
Ueda et al.

(10) Patent No.: US 8,430,212 B2
(45) Date of Patent: Apr. 30, 2013

(54) SAFETY CONTROL DEVICE FOR AN ELEVATOR APPARATUS AND OPERATING METHOD THEREOF

(75) Inventors: Takaharu Ueda, Tokyo (JP); Satoru Takahashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 308 days.

(21) Appl. No.: 12/937,800

(22) PCT Filed: Jun. 27, 2008

(86) PCT No.: PCT/JP2008/061730

§ 371 (c)(1),
(2), (4) Date: Oct. 14, 2010

(87) PCT Pub. No.: WO2009/157085

PCT Pub. Date: Dec. 30, 2009

(65) Prior Publication Data

US 2011/0036667 A1 Feb. 17, 2011

(51) Int. Cl.
*B66B 1/34* (2006.01)

(52) U.S. Cl.
USPC ..... 187/391; 187/247; 187/289

(58) Field of Classification Search ..... 187/247, 187/248, 391–393, 288, 289
See application file for complete search history.

(56) References Cited

U.S. PATENT DOCUMENTS

| | | | | |
|---|---|---|---|---|
| 4,350,225 | A * | 9/1982 | Sakata et al. | 187/248 |
| 5,407,028 | A * | 4/1995 | Jamieson et al. | 187/288 |
| 5,787,020 | A * | 7/1998 | Molliere et al. | 702/183 |
| 5,893,432 | A * | 4/1999 | Nguyen et al. | 187/290 |
| 6,173,813 | B1 * | 1/2001 | Rebillard et al. | 187/287 |
| 6,173,814 | B1 * | 1/2001 | Herkel et al. | 187/288 |
| 7,575,102 | B2 * | 8/2009 | Matsuoka | 187/391 |
| 7,721,852 | B2 * | 5/2010 | Ishioka et al. | 187/391 |
| 7,896,135 | B2 * | 3/2011 | Kattainen et al. | 187/248 |
| 7,909,145 | B2 * | 3/2011 | Erny et al. | 187/393 |
| 8,096,387 | B2 * | 1/2012 | Kattainen et al. | 187/248 |
| 8,235,180 | B2 * | 8/2012 | Kattainen et al. | 187/288 |
| 2012/0186914 | A1 * | 7/2012 | Birrer | 187/247 |

FOREIGN PATENT DOCUMENTS

| | | |
|---|---|---|
| CN | 101027238 A | 8/2007 |
| WO | 03 008316 | 1/2003 |
| WO | 2005 082765 | 9/2005 |
| WO | 2006 090470 | 8/2006 |

OTHER PUBLICATIONS

International Search Report issued Mar. 17, 2009 in PCT/JP08/61730 filed Jun. 27, 2008.
Chinese Office Action issued Aug. 28, 2012, in Patent Application No. 200880129267.3 (with English-language translation).

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An elevator apparatus includes a safety circuit section including a plurality of abnormality detection units, a safety control device, failure detection unit, and circuit changeover unit. The safety control device controls electric power supply to a driving device and a brake device in accordance with a content of an abnormality detected by the abnormality detection units. The failure detection unit detects a failure of the safety control device. When the failure of the safety control device is detected, the circuit changeover unit forms a failure-time circuit in which the electric power supply to the driving device and the brake device is interrupted directly by the abnormality detection unit.

7 Claims, 5 Drawing Sheets

SAFETY CONTROL DEVICE FOR AN ELEVATOR APPARATUS AND OPERATING METHOD THEREOF

TECHNICAL FIELD

The present invention relates to an elevator apparatus including a safety control device for controlling electric power supply to a driving device and a brake device in accordance with a content of an abnormality detected by abnormality detection means, and to a method of operating the same.

BACKGROUND ART

In a conventional elevator apparatus, signals from various sensors are input to a detection circuit main body including a processing section (a CPU). When some abnormality is detected by the detection circuit main body, a main contact of a safety relay of the safety circuit is opened. Further, for verifying whether or not the main contact of the safety relay normally operates, a safety relay command signal for opening the main contact of the safety relay is generated by the detection circuit main body when a car is stopped (for example, see Patent Document 1).

Further, in another conventional elevator apparatus, when a person is in a danger zone or is going to enter the danger zone, a driving unit for a car is switched to be operated in a special operation mode. In the special operation mode, the car is prevented from being moved into the danger zone (for example, see Patent Document 2).

Patent Document 1: WO2005/082765

Patent Document 2: JP 2004-534707 A

DISCLOSURE OF THE INVENTION

Problem to be Solved by the Invention

In the conventional elevator apparatus as described above, however, when a failure of the detection circuit main body or special control equipment for executing the special operation mode occurs, it is necessary to cause the car to make an emergency stop to suspend a travel so as to prevent the car from being brought into an unstable state. As a result, operation efficiency is greatly lowered.

The present invention has been made to solve the problem described above, and has an object to provide an elevator apparatus which allows a car to travel even in case of a failure of a safety control device so as to prevent operation efficiency from being lowered and a method of operating the same.

Means for Solving the Problem

According to the present invention, there is provided an elevator apparatus including: a car; a driving device for raising and lowering the car; a brake device for braking running of the car; a travel control device for controlling the driving device and the brake device; and a safety circuit section including: a plurality of abnormality detection means; a safety control device for controlling electric power supply to the driving device and the brake device in accordance with a content of an abnormality detected by the plurality of abnormality detection means; failure detection means for detecting a failure of the safety control device; and circuit changeover means for forming a failure-time circuit in which the electric power supply to the driving device and the brake device is interrupted directly by the plurality of abnormality detection means when the failure of the safety control device is detected.

Further, according to the present invention, there is provided a method of operating an elevator apparatus including: allowing a car to travel while a safety control device for monitoring whether or not there is an abnormality with a plurality of abnormality detection means and for controlling electric power supply to a driving device and a brake device in accordance with a content of the abnormality detected by the plurality of abnormality detection means is enabled during a normal operation; and continuing the travel of the car while the electric power supply to the driving device and the brake device is interrupted directly by the plurality of abnormality detection means when a failure of the safety control device occurs.

BEST MODE FOR CARRYING OUT THE INVENTION

Figure 1:
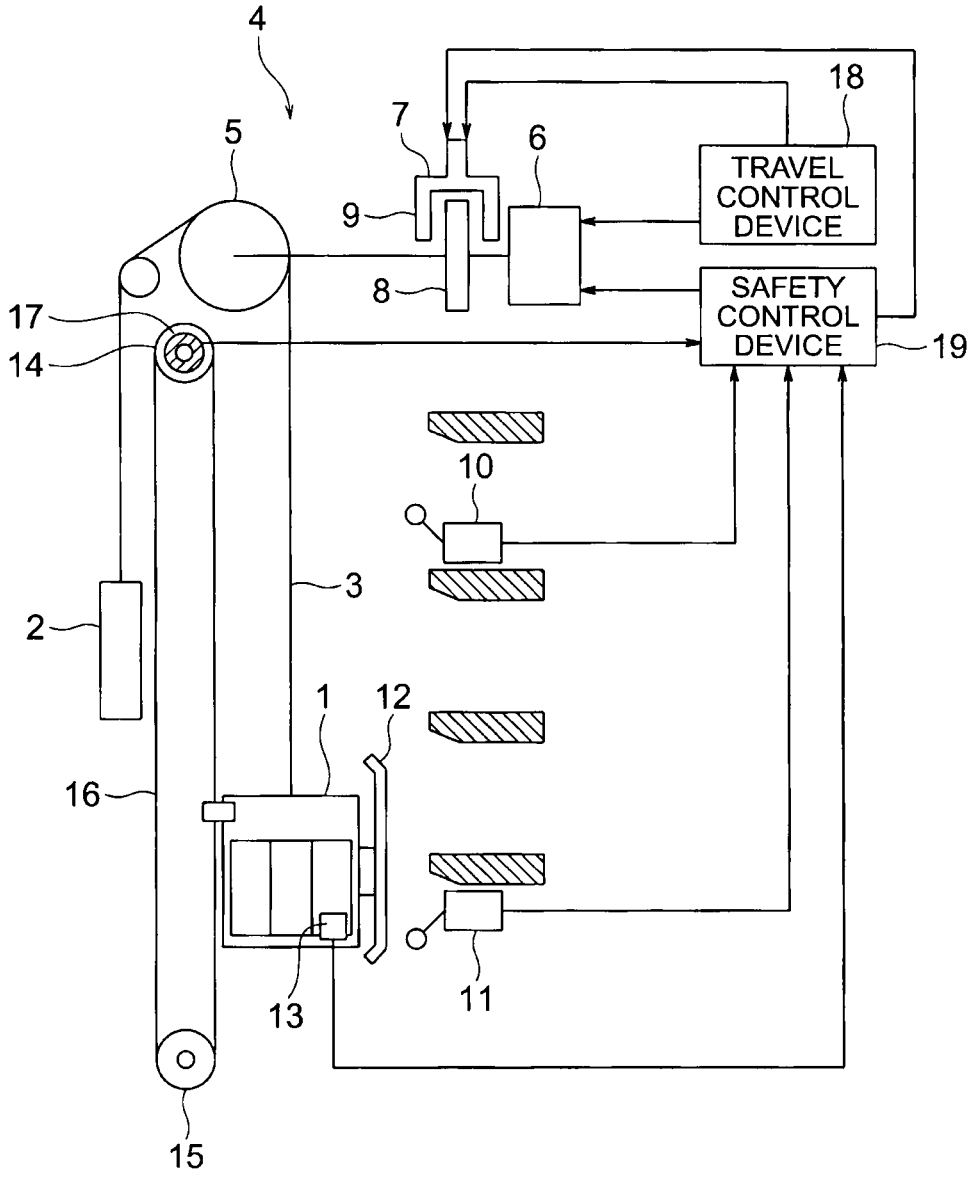
FIG. 1 is a configuration diagram illustrating an elevator apparatus according to a first embodiment of the present invention.

Hereinafter, preferred embodiments of the present invention are described referring to the drawings.

First Embodiment

FIG. 1 is a configuration diagram illustrating an elevator apparatus according to a first embodiment of the present invention. In the drawing, a car 1 and a counterweight 2 are suspended by suspension means 3 in a hoistway, and are raised and lowered by a driving force of a hoisting machine 4 in the hoistway. As the suspension means 3, a plurality of ropes or a plurality of belts are used.

The hoisting machine 4 includes a driving sheave 5 around which the suspension means 3 is looped, a hoisting machine motor 6 serving as a driving device for rotating the driving sheave 5, and a brake device 7 for braking the rotation of the driving sheave 5. The brake device 7 includes a brake drum 8 coaxially connected to the driving sheave 5, a brake shoe 9 which is brought into contact with and separated away from the brake drum 8, a brake spring (not shown) for pressing the brake shoe 9 against the brake drum 8 to apply a braking force thereto, and an electromagnetic magnet (not shown) for separating the brake shoe 9 away from the brake drum 8 against the brake spring to cancel the braking force.

In the vicinity of a top terminal landing of the hoistway, an upper hoistway switch 10 is provided. In the vicinity of a bottom terminal landing of the hoistway, a lower hoistway switch 11 is provided. An operation cam 12 for operating the hoistway switches 10 and 11 is mounted to the car 1.

A car-door open detection switch 13 for detecting that a car door is open is provided to the car 1. A landing-door open detection switch (not shown) for detecting that a landing door is open is provided to a landing at each floor.

In an upper part of the hoistway, an upper pulley 14 is provided. In a lower part of the hoistway, a lower pulley 15 is provided. An overspeed detection rope 16 is looped around the upper pulley 14 and the lower pulley 15. Both ends of the overspeed detection rope 16 are connected to the car 1. The overspeed detection rope 16 is circulated along with the ascent/descent of the car 1. As a result, the upper pulley 14 is rotated at a speed according to a running speed of the car 1. An overspeed detection switch 17 for detecting that the running speed of the car 1 has reached a preset overspeed is provided to the upper pulley 14.

The hoisting machine motor 6 and the brake device 7 are controlled by a travel control device 18. Specifically, a travel of the car 1 is controlled by the travel control device 18. The travel control device 18 controls the hoisting machine motor 6 to raise and lower the car 1, and maintains a stationary state of the car 1 with the brake device 7 at a target floor. Further, the travel control device 18 includes a microcomputer which stores a program for the travel of the car 1 therein.

Signals from the upper hoistway switch 10, the lower hoistway switch 11, the car-door open detection switch 13, the landing-door open detection switches, and the overspeed detection switch 17 are input to a safety control device (an electronic safety controller) 19. The safety control device 19 monitors whether or not there is an abnormality in the elevator apparatus, independently of the travel control device 18.

The safety control device 19 controls electric power supply to the hoisting machine motor 6 and the brake device 7 based on the signals from various sensors including the upper hoistway switch 10, the lower hoistway switch 11, the car-door open detection switch 13, the landing-door open detection switches, and the overspeed detection switch 17.

Further, the safety control device 19 includes a microcomputer. A program for controlling the electric power supply to the hoisting machine motor 6 and the brake device 7 in accordance with the content the content of a detected abnormality is stored in the microcomputer of the safety control device 19.

Figure 2:
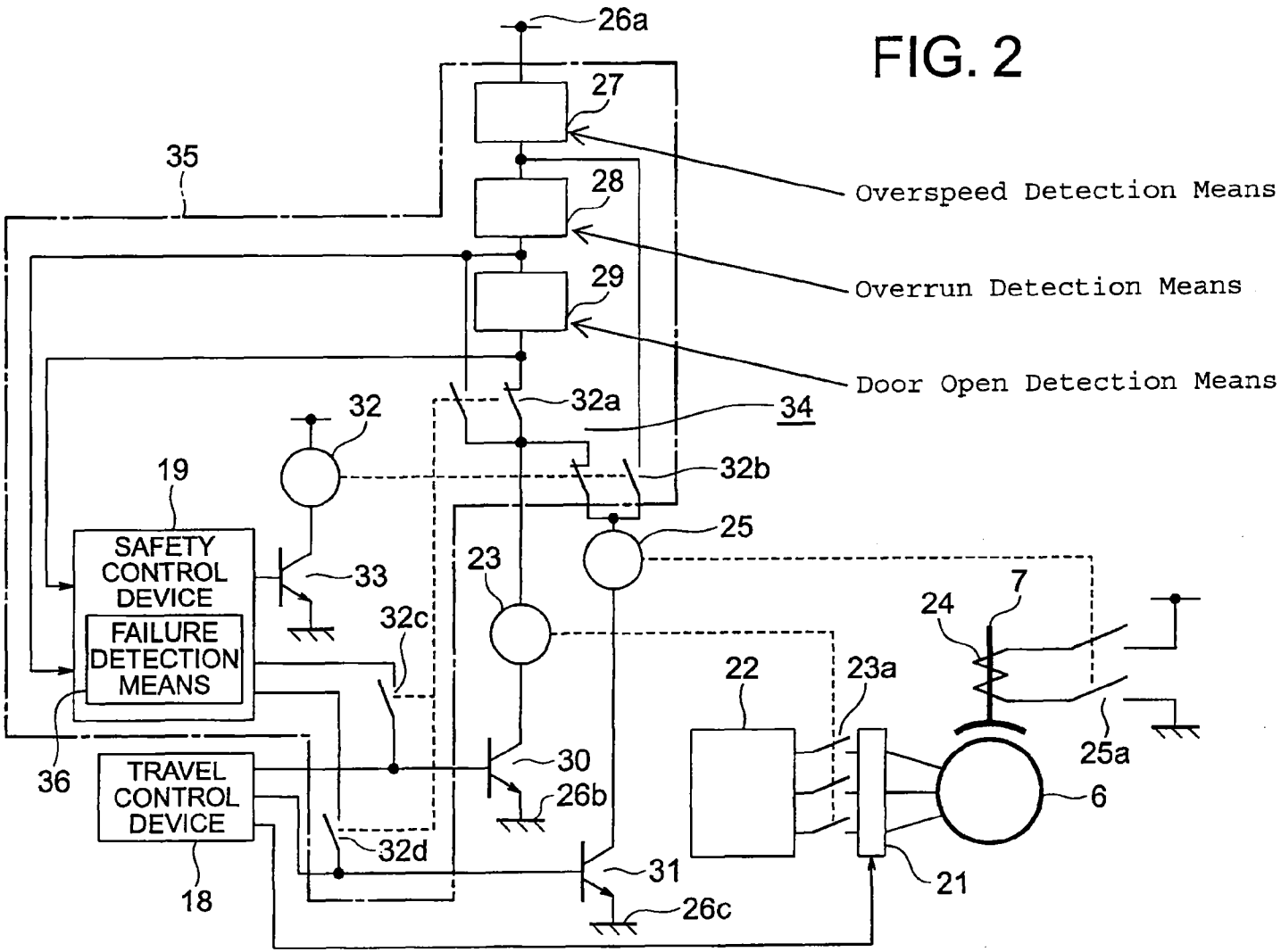
FIG. 2 is a circuit diagram illustrating a principal part of FIG. 1.

FIG. 2 is a circuit diagram illustrating a principal part of FIG. 1. The hoisting machine motor 6 is connected to a motor power source section 22 through an intermediation of an inverter 21 for controlling a speed of the car 1. The inverter 21 is controlled by the travel control device 18.

A motor power source contact portion 23*a* is provided between the inverter 21 and the motor power source section 22. The motor power source contact portion 23*a* is opened and closed by a motor power source electromagnetic coil 23. More specifically, the motor power source contact portion 23*a* is closed by excitation of the motor power source electromagnetic coil 23, whereas the motor power source contact portion 23*a* is opened by a de-excited state of the motor power source electromagnetic coil 23.

The electromagnetic magnet of the brake device 7 includes a brake coil 24. A brake power source contact portion 25*a* is provided between the brake coil 24 and the power source. The brake power source contact portion 25*a* is opened and closed by a brake power source electromagnetic coil 25. More specifically, the brake power source contact portion 25*a* is closed by excitation of the brake power source electromagnetic coil 25, whereas the brake power source contact portion 25*a* is opened by a de-excited state of the brake power source electromagnetic coil 25.

A safety circuit power source 26*a* for supplying the electric power to the motor power source electromagnetic coil 23 and the brake power source electromagnetic coil 25 is backed up by a battery or the like. A plurality of abnormality detection means for detecting abnormal states of the elevator apparatus, which are different from each other, specifically, overspeed detection means 27, overrun detection means 28, and door-open detection means 29 are connected in series to the safety circuit power source 26*a*.

The overspeed detection means 27 is provided with the overspeed detection switch 17 and a switch for an emergency terminal speed limiting device. The overrun detection means 28 is provided with the upper hoistway switch 10 and the lower hoistway switch 11. The door open detection means 29 is provided with the car-door open detection switch 13 and the landing-door open detection switches. The aforementioned switches are all connected in series.

Signals on both sides of the door open detection means 29 are input to the safety control device 19. The safety control device 19 determines the content of the detected abnormality based on the input signals.

The motor power source electromagnetic coil 23 and the brake power source electromagnetic coil 25 are connected in parallel to the safety circuit power source 26*a*. A motor power source control switch 30 is provided between the motor power source electromagnetic coil 23 and a ground 26*b*. A brake power source control switch 31 is provided between the brake power source electromagnetic coil 25 and a ground 26*c*.

As each of the motor power source control switch 30 and the brake power source control switch 31, for example, a semiconductor switch is used. Further, ON/OFF of the motor power source control switch 30 is controlled by the travel control device 18 and the safety control device 19. Further, ON/OFF of the brake power source control switch 31 is also controlled by the travel control device 18 and the safety control device 19.

A first circuit changeover contact portion 32*a* is provided between the motor power source electromagnetic coil 23 and the detection means 27 to 29. A second circuit changeover contact portion 32*b* is provided between the brake power source electromagnetic coil 25 and the detection means 27 to 29. A third circuit changeover contact portion 32*c* is provided between the safety control device 19 and the motor power source control switch 30. A fourth circuit changeover contact portion 32*d* is provided between the safety control device 19 and the brake power source control switch 31.

The first to fourth circuit changeover contact portions 32*a* to 32*d* are opened and closed by a circuit changeover electromagnetic coil 32. A circuit changeover control switch 33 is provided between the circuit changeover electromagnetic coil 32 and a ground. As the circuit changeover control switch 33, for example, a semiconductor switch is used, and ON/OFF of the circuit changeover control switch 33 is controlled by the safety control device 19.

Circuit changeover means 34 of the first embodiment includes the first to fourth circuit changeover contact portions 32*a* to 32*d*, the circuit changeover electromagnetic coil 32, and the circuit changeover control switch 33. A safety circuit section 35 of the first embodiment includes the safety control device 19, the detection means 27 to 29, and the circuit changeover means 34.

Figure 3:
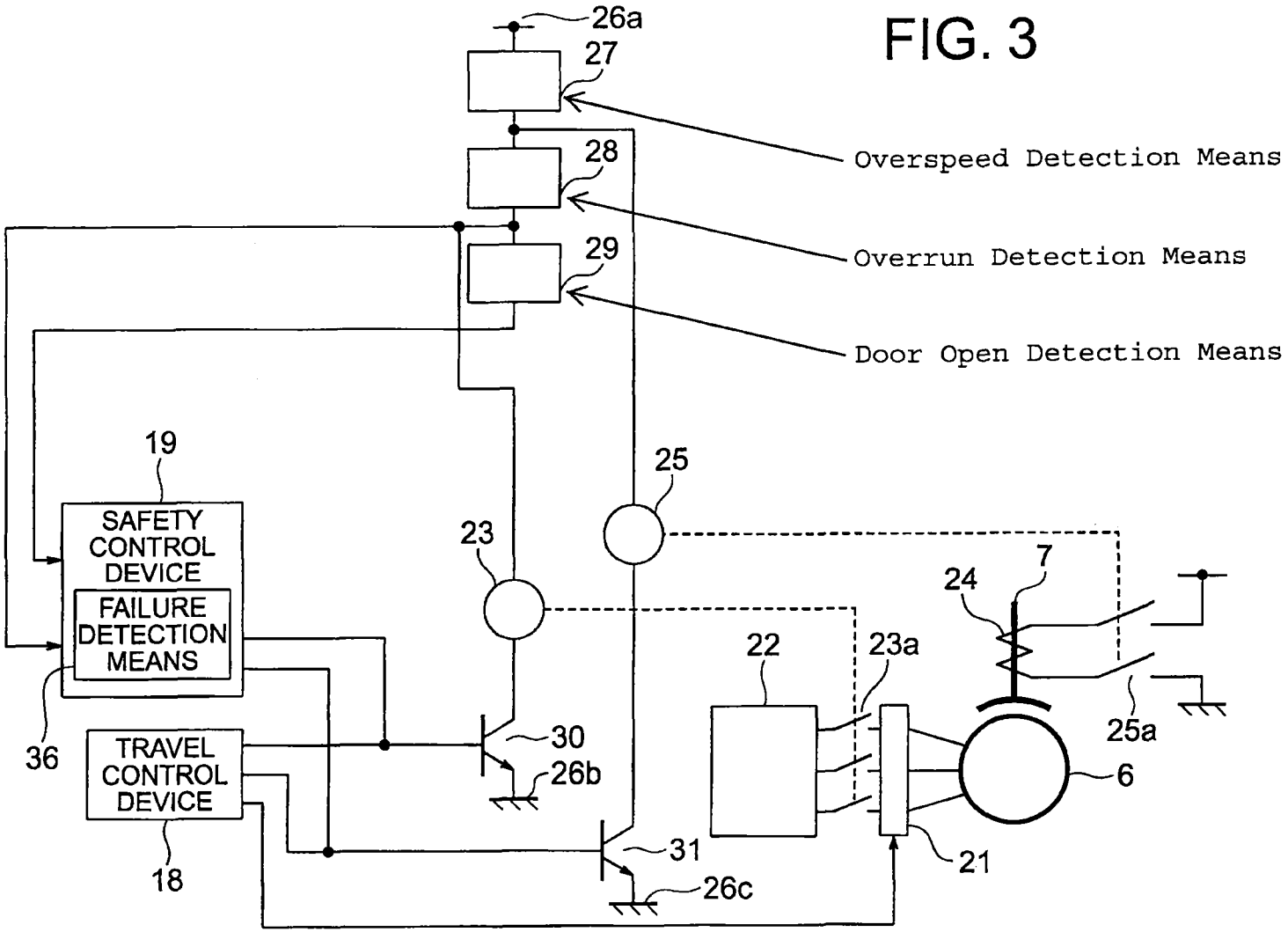
FIG. 3 is a circuit diagram illustrating a state in which a first circuit is formed in a safety circuit section illustrated in FIG. 2.

The circuit changeover means 34 switches a circuit configuration in the safety circuit section 35 between a first circuit (FIG. 3) for enabling the control by the safety control device 19 and a second circuit (FIG. 4) obtained by disconnecting the safety control device 19.

Failure detection means 36 for detecting a failure of the safety control device 19 itself is included in the safety control device 19. The failure detection means 36 is realized by, for example, configuring dual-system (or multiple-system) computing sections of the safety control device 19 so that each of the computing sections monitors an operation of the other. More specifically, the computing sections (CPUs or the like) independent of each other execute the same computation processing and compare their own computation results with each other. When a difference between the computation results is equal to or larger than a threshold value, it is determined that the failure has occurred in any one of the computing sections.

When the failure of the safety control device 19 is not detected by the failure detection means 36, the circuit changeover switch 33 is held in an ON state. As a result, the circuit changeover electromagnetic coil 32 is excited, and the first circuit (a normal-time circuit) is formed in the safety circuit section 35.

On the other hand, when the failure of the safety control device 19 is detected by the failure detection means 36, the circuit changeover control switch 33 is turned OFF. As a result, the circuit changeover electromagnetic coil 32 is brought into a de-excited state to switch the circuit configuration in the safety circuit section 35 to the second circuit (a failure-time circuit).

Next, the first and second circuits are described. First, in the first circuit illustrated in FIG. 3, when an overspeed of the car 1 is detected by the overspeed detection means 27, an electrical circuit is interrupted in the overspeed detection means 27. Therefore, the power source electromagnetic coils 23 and 25 are forcibly brought into a de-excited state regardless of whether the power source control switches 30 and 31 are ON or OFF. As a result, the power source contact portions 23*a* and 25*a* are opened. In this manner, the car 1 is caused to immediately make an emergency stop.

Further, when the overrun of the car 1 is detected by the overrun detection means 28 in the first circuit, an electrical circuit is interrupted in the overrun detection means 28. Therefore, the motor power source electromagnetic coil 23 is forcibly brought into a de-excited state regardless of whether the motor power source control switch 30 is ON or OFF. As a result, the motor power source contact portion 23*a* is opened. In this manner, the electric power supply to the hoisting machine motor 6 is interrupted.

However, the brake power source electromagnetic coil 25 is connected to the safety circuit power source 26*a* at upstream of the overrun detection means 28. Therefore, even after the electrical circuit is interrupted in the overrun detection means 28, the brake power source electromagnetic coil 25 remains connected to the safety circuit power source 26*a*, and therefore, is in a state in which the control by the safety control device 19 can be performed thereon.

Upon detection of the abnormality by the overrun detection means 28, the safety control device 19 controls the brake power source control switch 31 to cause the car 1 to make the emergency stop while controlling the braking force of the brake device 7. Specifically, the safety control device 19, for example, intermittently applies the braking force of the brake device 7 so that a deceleration rate of the car 1 does not become excessively large when the car 1 is caused to make the emergency stop, thereby controlling the braking force of the brake device 7.

Further, in the first circuit, upon detection of abnormal opening of the car door or the landing door by the door open detection means 29, the power source control switches 30 and 31 are controlled by the safety control device 19. More specifically, if the car 1 is located in a door zone (a predetermined range from a landing level), the safety control device 19 allows the brake device 7 to perform a braking operation after the landing of the car 1. If the car 1 is located outside the door zone, the safety control device 19 immediately interrupts the electric power supply to the hoisting machine motor 6 while performing the deceleration rate control to cause the car 1 to make the emergency stop.

Figure 4:
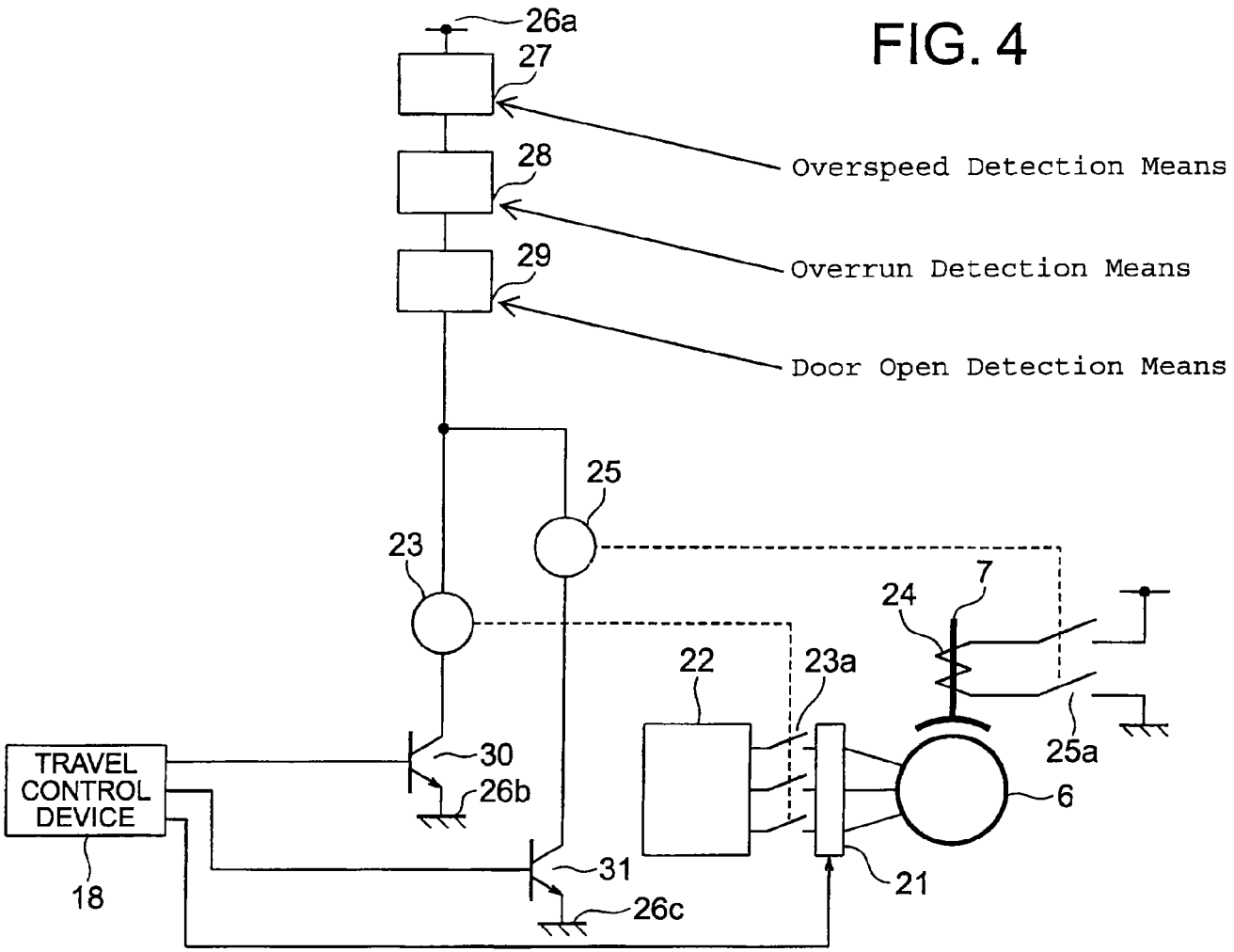
FIG. 4 is a circuit diagram illustrating a state in which a second circuit is formed in the safety circuit section illustrated in FIG. 2.

Next, in the second circuit illustrated in FIG. 4, that is, the failure-time circuit, the safety control device 19 is disconnected from the power source electromagnetic coils 23 and 25 to be disabled. However, a safety circuit, in which the detection means 27 to 29 are connected in series, is formed between the power source electromagnetic coils 23 and 25 and the safety circuit power source 26*a*.

In the second circuit described above, when the abnormality is detected by any one of the detection means 27 to 29 to interrupt the electrical circuit, both the motor power source electromagnetic coil 23 and the brake power source electromagnetic coil 25 are forcibly brought into the de-excited state to cause the car 1 to immediately make the emergency stop. Specifically, the electric power supply to the hoisting machine motor 6 and the brake device 7 is interrupted directly by the detection means 27 to 29 without an intermediation of the safety control device 19.

Therefore, in the elevator apparatus according to the first embodiment, during a normal operation, the car 1 travels while whether or not there is any abnormality is being monitored by the detection means 27 and 29 and the safety control device 19 is enabled. When the failure occurs in the safety control device 19, the travel of the car 1 is continued while the electric power supply to the hoisting machine motor 6 and the brake device 7 is interrupted directly by the detection means 27 to 29.

In the elevator apparatus as described above, the safety circuit section 35 includes the failure detection means 36 for detecting the failure of the safety control device 19, and the circuit changeover means 34 which forms the circuit in which the control by the safety control device 19 is disabled so that the electric power supply to the hoisting machine motor 6 and the brake device 7 is interrupted directly by the detection means 27 to 29 in case of the failure of the safety control device 19. Therefore, the car 1 can travel even in case of the failure of the safety control device 19 to prevent operation efficiency from being lowered.

The correspondence relation between the type of abnormality and the type of control performed by the safety control device 19 for the abnormality is not limited to that described in the aforementioned example. Therefore, for example, the positions of the detection means 27 to 29 may be appropriately interchanged with each other.

Further, although the failure detection means 36 is provided to the safety control device 19 in the aforementioned example, the failure detection means 36 may be provided outside the safety control device 19, independently of the safety control device 19.

Further, the circuit changeover means 32 may be configured by the multiple system so that the first circuit in the safety circuit section 35 is switched to the second circuit by a switching operation to the second circuit, which is performed by at least one system. In this case, reliability can be improved.

Further, for switching from the first circuit to the second circuit, the switching may be performed after the power source electromagnetic coils 23 and 25 are temporarily disconnected from the safety circuit power source 26*a* to cause the car 1 to make the emergency stop or while the car 1 is being continuously operated without disconnecting the power source electromagnetic coils 23 and 25 from the safety circuit power source 26*a*.

Second Embodiment

Figure 5:
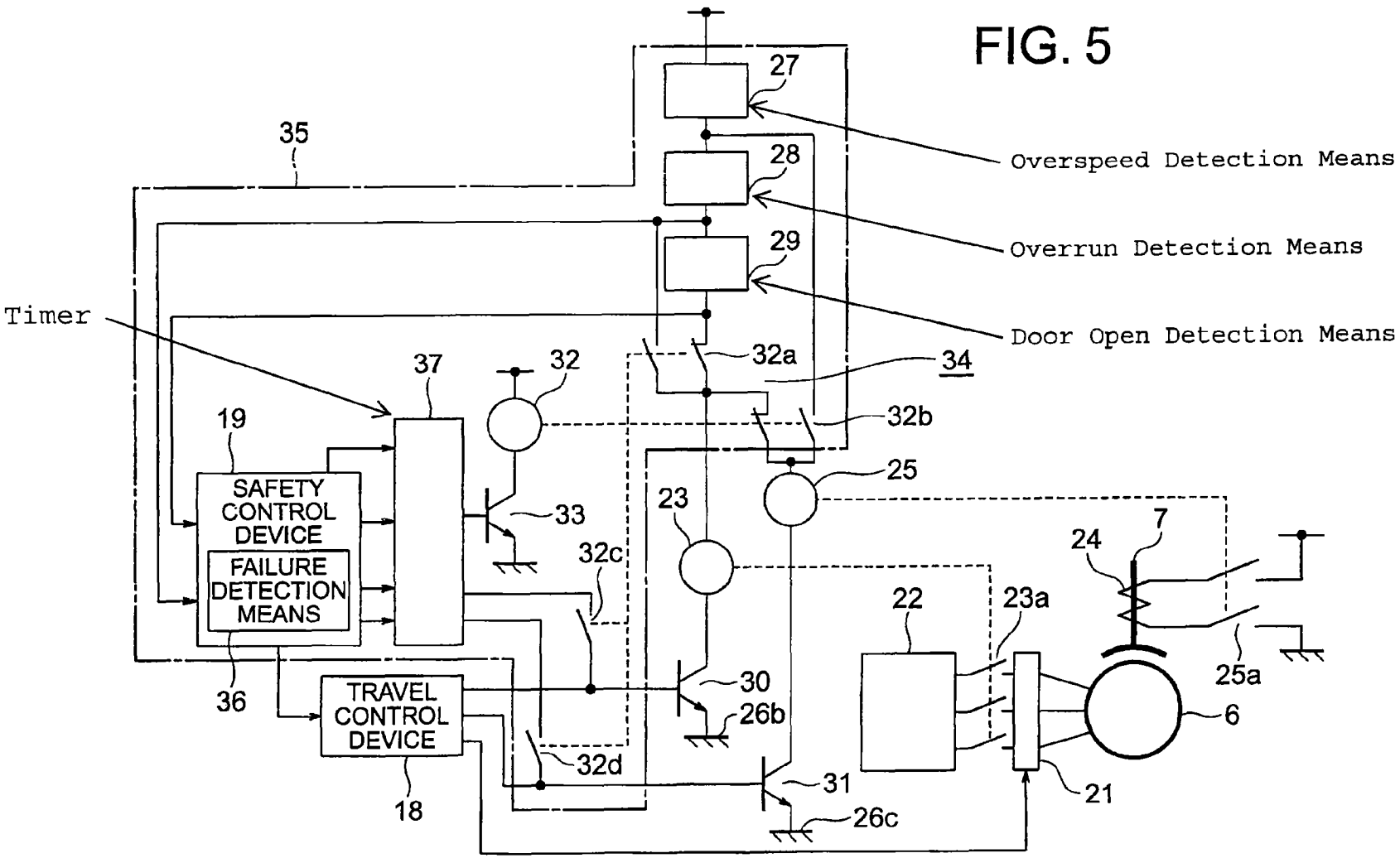
FIG. 5 is a circuit diagram illustrating a principal part of an elevator apparatus according to a second embodiment of the present invention.

Next, FIG. 5 is a circuit diagram illustrating a principal part of the elevator apparatus according to a second embodiment of the present invention. In this second embodiment, a timer 37 is provided between the safety control device 19 and the circuit changeover means 34. Upon detection of the failure of the safety control device 19 by the failure detection means 36, a time is measured by the timer 37. After elapse of a predetermined time, the circuit changeover control switch 33 is turned OFF to execute the switching to the second circuit.

Further, the safety control device 19 and the travel control device 18 are connected to each other so as to be communicable with each other. Upon detection of the failure of the safety control device 19 by the failure detection means 36, a failure-time operation command is output from the safety control device 19 to the travel control device 18.

Upon reception of the failure-time operation command, the travel control device 18 moves the car 1 to a predetermined floor (for example, the nearest floor) and then interrupts the electric power supply to the hoisting machine motor 6 and the brake device 7 to open the car door. Therefore, the time set for the timer 37 is long enough for the car 1 to run to the predetermined floor. The remaining configuration is the same as that of the first embodiment.

In the elevator apparatus described above, the switching to the second circuit is executed after elapse of the predetermined time from the detection of the failure of the safety control device 19. The car 1 is moved to the predetermined floor before the execution of the switching to the second circuit. Therefore, the car 1 is not caused to make a temporary emergency stop in case of the failure of the safety control device 19. Thus, service can be prevented from being degraded.

The driving device is not limited to the hoisting machine motor 6, and may be, for example, a linear motor mounted to the car 1 or the counterweight 2, or the like.

Further, although the brake device 7 for braking the rotation of the driving sheave 5 to brake the car 1 is described in the examples described above, the brake device is not limited thereto. For example, a brake (a rope brake) for gripping the suspension means 3 to brake the car 1, a brake (a car brake) mounted on the car 1, which is engaged with a guide rail to brake the car 1, or the like may be used.

Further, the number of the brakes is not limited to one. A plurality of the brakes may be used.

Further, although the car 1 is raised and lowered by the single hoisting machine 4 in the examples described above, the elevator apparatus may use a plurality of the hoisting machines.

The invention claimed is:

1. An elevator apparatus, comprising:
- a car;
- a driving device that raises and lowers the car;
- a brake device that brakes running of the car;
- a travel control device which controls the driving device and the brake device; and
- a safety circuit section including:
  - a plurality of abnormality detection units;
  - a safety control device that controls an electric power supply to the driving device and the brake device in accordance with a content of an abnormality detected by the plurality of abnormality detection units;
  - failure detection means for detecting a failure of the safety control device; and
  - circuit changeover means for forming a failure-time circuit when the failure of the safety control device is detected in which the electric power supply to the driving device and the brake device continues until the electric power supply is interrupted directly by any single one of the plurality of abnormality detection units when the single one of the plurality of detection units detects a respective abnormality condition.

2. The elevator apparatus according to claim 1, wherein
- the plurality of abnormality detection units are connected in series between a power source and electromagnetic coils, and
- the electromagnetic coils selectively enable the electric power supply to be provided to the driving device and the brake device.

3. The elevator apparatus according to claim 1, wherein the circuit changeover means executes switching to form the failure-time circuit after elapse of a predetermined time from the detection of the failure of the safety control device, and
- the travel control device moves the car to a predetermined floor before the execution of the switching to the failure-time circuit.

4. A method of operating an elevator apparatus, comprising:
- monitoring, with a safety control device during a normal operation of the safety control device, whether or not an abnormality has been detected by at least one of a plurality of abnormality detection units;
- operating a car to travel during the normal operation;
- controlling an electric power supply to a driving device and a brake device with the safety control device during the normal operation in accordance with a content of the abnormality detected by the plurality of abnormality detection units;
- detecting a failure of the safety control device;
- continuing the travel of the car after detecting the failure of the safety control device; and
- ending the travel of the car by interrupting the electric power supply to the driving device and the brake device directly with any single one of the plurality of abnormality detection units when a respective abnormality condition is detected.

5. An elevator apparatus, comprising:
- a car;
- a driving device that raises and lowers the car;
- a brake device that brakes running of the car;
- a travel control device which controls the driving device and the brake device; and
- a safety circuit section including:
  - a plurality of abnormality detection units;
  - a safety control device that controls an electric power supply to the driving device and the brake device in accordance with a content of an abnormality detected by the plurality of abnormality detection units;
  - a failure detection unit that detects a failure of the safety control device; and
  - a circuit changeover unit that switches the safety circuit section to form a failure-time circuit in which the electric power supply to the driving device and the brake device continues until the electric power supply is interrupted directly by any single one of the plurality of abnormality detection units when the failure of the safety control device is detected and the single one of the plurality detection units detects a respective abnormality condition.

6. The elevator apparatus according to claim 5, wherein
- the plurality of abnormality detection units are connected in series between a power source and electromagnetic coils, and the electromagnetic coils selectively enable the electric power supply to be provided to the driving device and the brake device.

7. The elevator apparatus according to claim 5, wherein the circuit changeover unit switches the safety circuit section to form the failure-time circuit after elapse of a predetermined time from the detection of the failure of the safety control device, and the travel control device moves the car to a predetermined floor before the execution of the switching to the failure-time circuit.

* * * * *